US006644994B1

(12) United States Patent
Lee

(10) Patent No.: US 6,644,994 B1
(45) Date of Patent: Nov. 11, 2003

(54) CONNECTOR WITH A FUNCTION OF GETTING RID OF SURGES

(76) Inventor: Chun Te Lee, No. 98-1, Lane Chin She Beei, Twen Chu, Taichung (TW)

( * ) Notice: Subject to any disclaimer, the term of this patent is extended or adjusted under 35 U.S.C. 154(b) by 0 days.

(21) Appl. No.: 10/136,320

(22) Filed: May 2, 2002

(51) Int. Cl.[7] ..... H01R 13/53

(52) U.S. Cl. ..... 439/181; 439/620; 361/119

(58) Field of Search ..... 439/181, 620, 439/578, 76.1, 92, 188; 361/119

(56) References Cited

U.S. PATENT DOCUMENTS 6,450,836 B1 * 9/2002 Youtsey ..... 439/620

* cited by examiner

*Primary Examiner*—Ross Gushi
(74) *Attorney, Agent, or Firm*—Troxell Law Office PLLC

(57) ABSTRACT

A connector with a function of getting rid of surge includes a connecting head made of metal, a clasp made of metal, placed in the connecting head and having a pinching portion made of two parallel elastic pieces, a base plate and an emitting pieces formed in the other end of the clasp, and an insulating housing. A gap is formed between the upper end of the emitting member and the inner surface of the connecting head so that a surge or a thunderbolt may flow through the gap to the connecting head and be led to the ground to disappear.

5 Claims, 3 Drawing Sheets

CONNECTOR WITH A FUNCTION OF GETTING RID OF SURGES

BACKGROUND OF THE INVENTION

This invention relates to a connector with a function of getting rid of surges, particularly to one possible to let surges to be flow to a metal connecting head and then to the ground to disappear.

A conventional connector shown in FIG. 1 includes a fixing base 2 having a connecting head 3, two symmetrical insulating members 4 fitted in the connecting head 3, and an elastic clasp 5 contained in the two insulating members 4 for catching hold of a cable 1. Then a guide wire of the cable 1 is inserted through a through hole 6 of one of the insulating member 4 to be caught in the elastic clasp 6.

However, as the two insulating members 4 are located between the metal connecting head 3 and the elastic clasp 5, if the cable 1 should receive a surge or a thunderbolt, the surge could not flow to the fixing base 2 to be led to the ground to disappear. Then electric or electronic appliances connected to the conventional connector might be damaged by the surge.

SUMMARY OF THE INVENTION

This Invention has been devised to offer a connector with a function of getting rid of surge. The connector is provided with an emitting piece and a connecting head in which the emitting piece is contained. Then a gap is formed between an upper end of the emitting piece and an inner surface of the connecting head so that a surge may flow through the gap to the metal connecting head and then to the ground to disappear.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
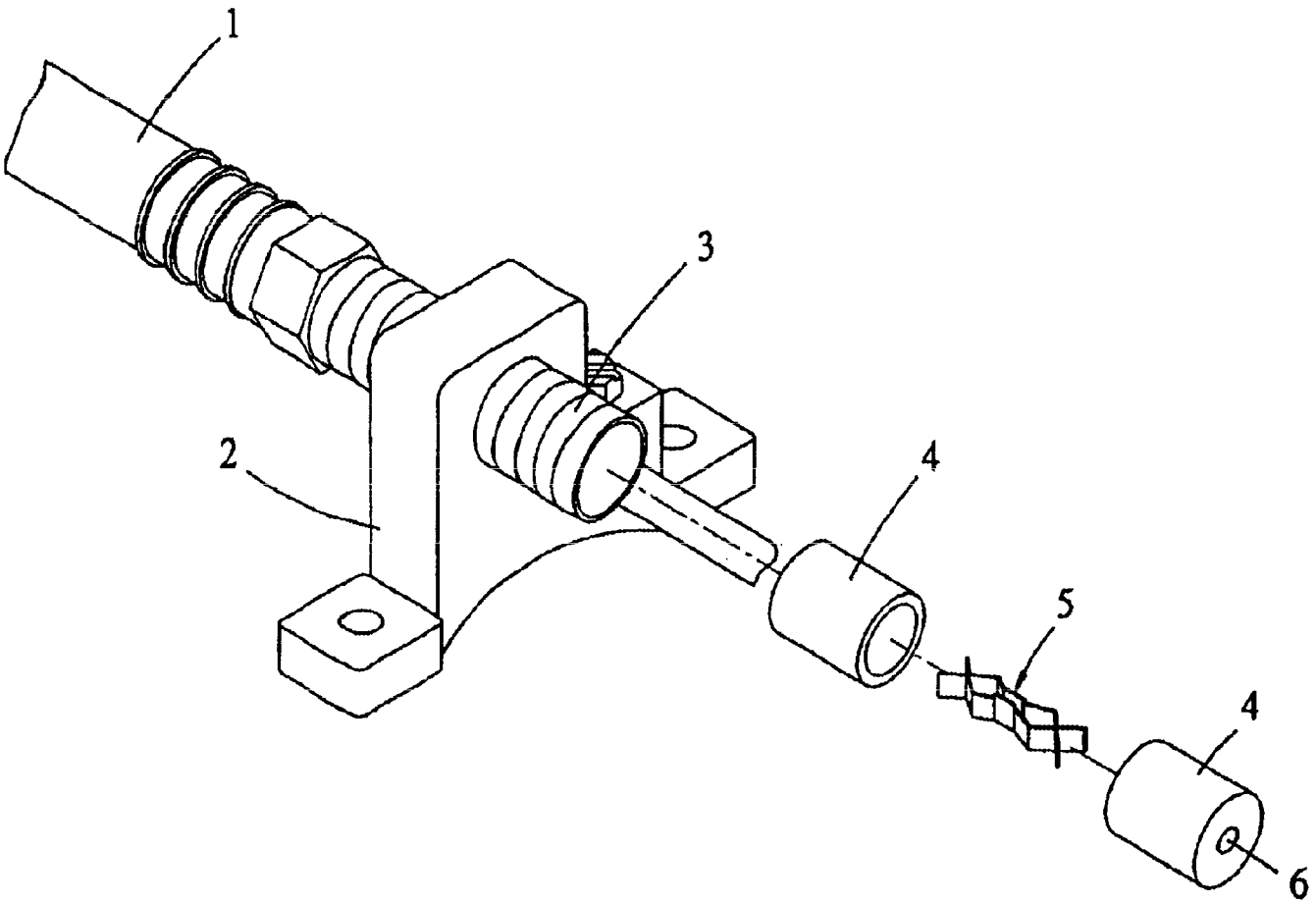
FIG. 1 PRIOR ART
FIG. 1 is an exploded perspective view of a conventional connector.
Figure 2:
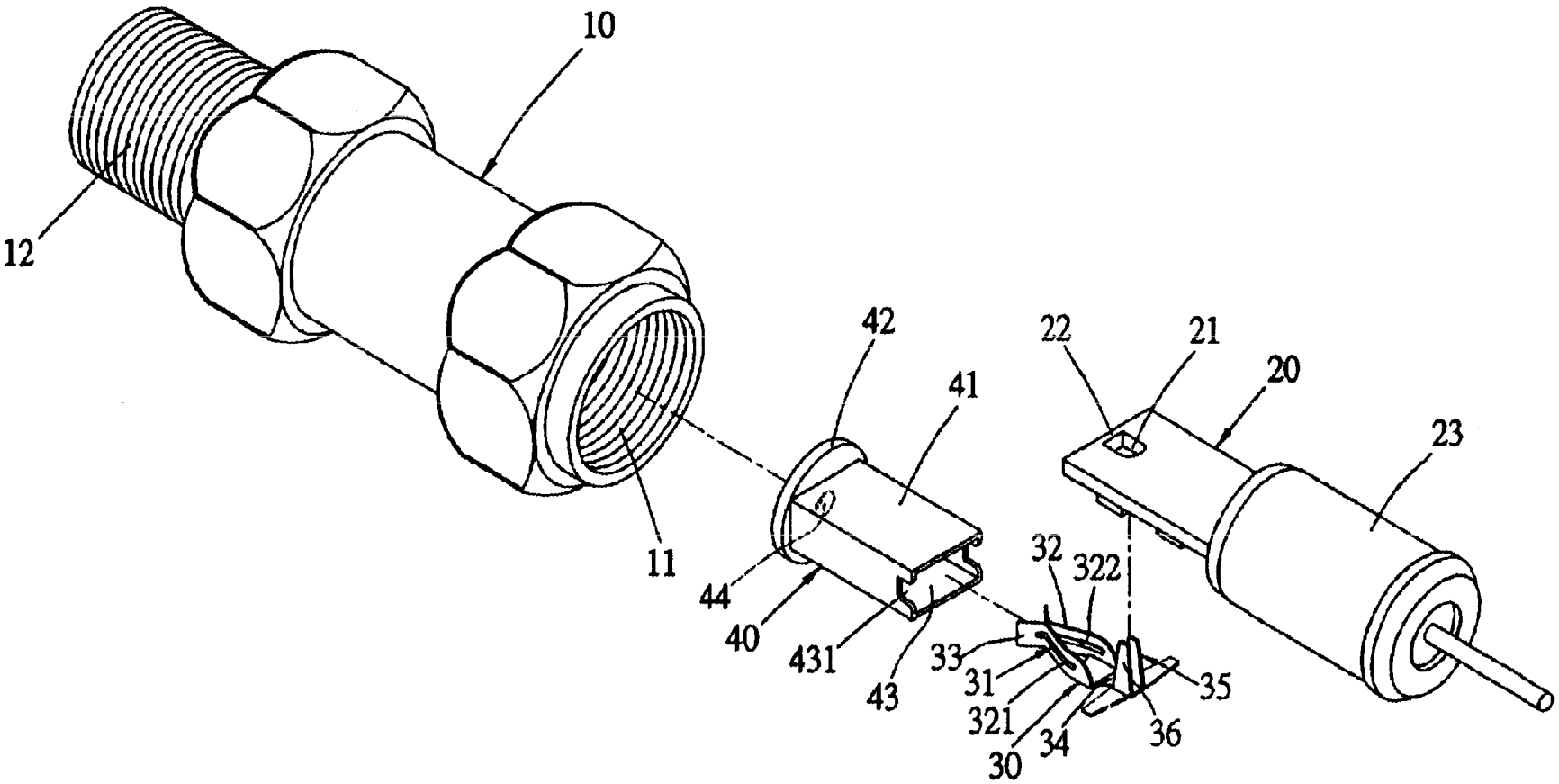
FIG. 2 is an exploded perspective view of a connector with a function of getting rid of surges in the present invention.
Figure 3:
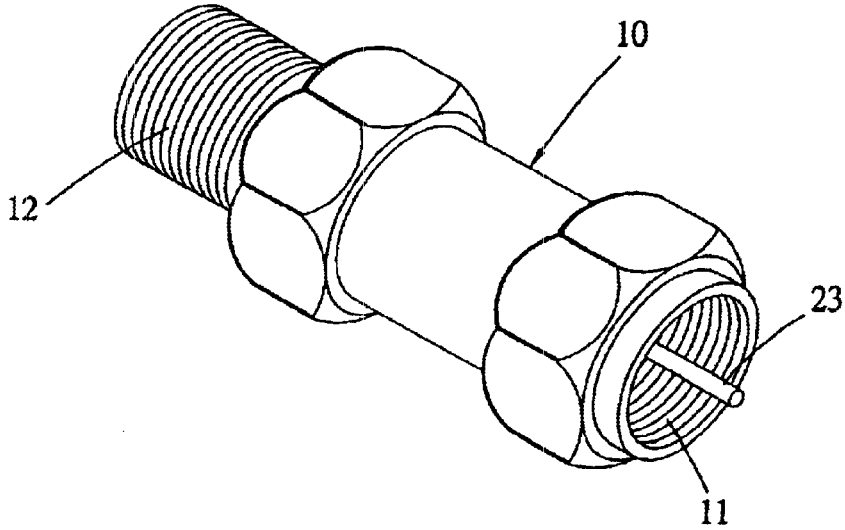
FIG. 3 is a perspective view of the connector in the present invention; and, FIG. 4 is a cross-sectional view of the connector in the present invention.

The preferred embodiment of the connector with a function of getting rid of surges in the present invention, as shown in FIGS. 2 and 3, includes a connecting head 10, a circuit board 20, a clasp 30, and an insulating housing 40 as main components combined together.

The connecting head 10 is made of metal and shaped as a hollow tube, having a first female threaded end 11 and a second male threaded end 12 respectively to engage with connecting heads of two cables.

The circuit board 20 has an electric circuit arranged thereon for getting rid of surges, provided with a round or rectangular hole 21 near an inner end portion 22 and an output end 23 fixed at the other end.

The clasp 30 is located in the connecting head 10, made integral of a metal conductive material, formed with a pinching portion 31 consisting of two parallel elastic pieces 32. The two elastic pieces 32 respectively have a projecting rib 321 formed on an outer surface and a narrow recess 322 formed in an inner surface, bending gradually toward each other and contacting at a point and then bending outward from each other to form an expanding end portion 33. The clasp 30 further has a base plate 34 and an emitting member 35 formed at an end opposite to the expanding end portion 33. The base plate 34 is located between the pinching portion 31 and the emitting member 35, and the emitting member 35 has two vertical emitting pieces 36 extending upward vertically from opposite ends of the base plate 34. The upper ends of the two emitting pieces 36 are separated with a gap from an inner surface of the connecting head 10, and the two emitting pieces 36 extends upward through the through hole 21 of the circuit board 20 to expose on the same board 20.

The insulating housing 40 is to receive the clasp 30 in its interior, and installed in the connecting head 10, constituted of a rectangular case 41 and a disc-shaped side plate 42 closed on an inner side of the case 41. The outer side of the case 41 is formed with an opening 43, and an insert slot 431 is formed respectively in opposite vertical sides of the opening 43. Then the clasp 30 is placed in the case 41 through the opening 43, and the circuit board 20 has its inner end inserted in the two insert slots 431 to secure the circuit board 20. Further, the side plate 42 has a center hole 44 communicating with the case 41.

Figure 4:
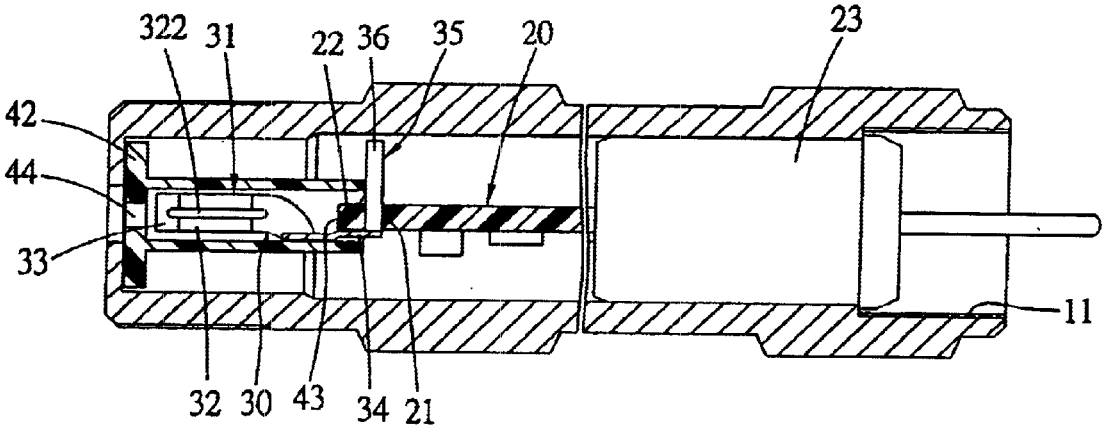

In assembling, as shown in FIGS. 3 and 4, firstly the emitting pieces 36 are made to extend upward through the through hole 21 of the circuit board 20, exposing and welded on the circuit board 20. Next, the clasp 30 is pushed and placed in the case 41 of the insulating housing 40, with the inner end of the circuit board 20 inserting in the two insert slots 431 to secure the circuit board 20 and with the emitting pieces 36 exposing out of the case 41. Finally, the insulating housing 40 with the clasp 30 and the circuit board 20 is pushed and placed in the connecting head 10, finishing assembly of the connector in the present invention.

In using, the first and the second end 11 and 12 of the connecting head are respectively engaged with the threaded heads of two cables, and the wire end of one of the cables is pinched tightly in the pinching portion 31 of the clasp 30. In case the connector in the invention should receive a surge or a thunderbolt, the surge would flow through the gap between the emitting pieces 36 of the clasp 30 and the inner surface of the connecting head 10, reaching the metal connecting head 10 and then to the ground to disappear, with the surge gotten rid of, protecting related electric or electronic appliances connected to the connector in the invention.

While the preferred embodiment of the invention has been described above, it will be recognized and understood that various modifications may be made therein and the appended claims are intended to cover all such modifications that may fall within the spirit and scope of the invention.

I claim:

1. A connector with a function of getting rid of surges comprising:

a connecting head made of a metal and shaped as a hollow tube;

an insulating housing contained in said connecting head; and a clasp contained in said insulating housing, the clasp being made of a metal conductive material, said clasp having a pinching portion consisting of two elastic pieces, said pinching portion connected with a base plate, said base plate having an emitting member, said emitting member having at least an emitting piece, and a gap formed between an upper end of said emitting piece and an inner surface of said connecting head, wherein said emitting portion has said emitting piece respectively extending from two opposite ends of said base plate and bending upward and vertical to said base plate.

2. A connector with a function of getting rid of surge comprising:

a connecting head made of a metal and shaped as a hollow tube;

an insulating housing contained in said connecting head; and a clasp contained in said insulating housing, the clasp being made of a metal conductive material, said clasp having a pinching portion consisting of two elastic pieces, said pinching portion connected with a base plate, said base plate having an emitting member, said emitting member having at least an emitting piece, and a gap formed between an upper end of said emitting piece and an inner surface of said connecting head, wherein a circuit board is further connected to said emitting member of said clasp, said circuit board has an electric circuit arranged thereon for getting rid of surges, and a through hole bored near an inner end portion, and said through hole is for said emitting pieces to extend upward through.

3. The connector with a function of getting rid of surge as claimed in claim 2, wherein said through hole of said circuit board is round.

4. The connector with a function of getting rid of surge as claimed in claim 2, wherein said through hole of said circuit board is rectangular.

5. The connector with a function of getting rid of surge as claimed in claim 2, wherein said insulating housing is constituted of a case and a side plate closed on an inner side of said case, said case having an outer side formed with an opening, an insert slot formed respectively in opposite vertical sides of said opening, said clasp placed in said case through said opening, an inner end of said circuit board fitted in said two insert slots of said opening of said case, said side plate having a center through hole.

* * * * *